United States Patent [19]

James

[11] Patent Number: 4,715,069

[45] Date of Patent: Dec. 29, 1987

[54] TOILET AIDS

[75] Inventor: David R. James, Tirley, England

[73] Assignee: James Industries Limited, Gloucester, England

[21] Appl. No.: 870,146

[22] Filed: Jun. 3, 1986

[30] Foreign Application Priority Data

Jul. 5, 1985 [GB] United Kingdom ..... 8517136

[51] Int. Cl.[4] ..... E03D 11/00

[52] U.S. Cl. ..... 4/254; 4/252 R

[58] Field of Search ..... 4/661, 254, 251, 240

[56] References Cited

U.S. PATENT DOCUMENTS

| | | | |
|---|---|---|---|
| 3,383,714 | 5/1968 | Minasian et al. | 4/254 |
| 3,405,411 | 10/1968 | Brown | 4/254 |
| 3,854,773 | 12/1974 | Thomas | 4/254 X |
| 3,969,778 | 7/1976 | Richards | 4/254 |
| 4,144,597 | 3/1979 | Guenther et al. | 4/254 |
| 4,196,480 | 4/1980 | Guenther et al. | 4/254 |
| 4,343,052 | 8/1982 | Guenther | 4/254 |

*Primary Examiner*—Henry K. Artis

*Attorney, Agent, or Firm*—Collard, Roe & Galgano

[57] ABSTRACT

A toilet aid comprises a rear fixing bracket for mounting on a WC pan using the normal seat attachment bolt holes of the latter. Side support legs and side support arms are mounted on the bracket, the support leg and arm at each side of the toilet aid being secured to a corresponding end lug of the fixing bracket by a common pivot bolt. The two pivot bolts are aligned to define a common horizontal pivot axis for separate pivotal movement of the legs and the arms, with the former contacting the floor more or less directly below handgrips provided at the outer ends of the respective side support arms. The inner ends of the arms respectively engage the legs below the pivot axis to provide a reaction support for weight loading of the support arms.

8 Claims, 3 Drawing Figures

TOILET AIDS

BACKGROUND OF THE INVENTION

1. Field of the Invention

The invention relates to toilet aids designed to assist disabled, elderly and infirm patients to use a WC, and of the type which is fixed relatively to the WC pan and provides side support arms for a user. Such an aid helps a user to manoeuvre on to and off the toilet seat, thereby in many cases enabling him to do so unaided, and provides side support when seated.

2. Description of the Prior Art

A toilet aid of the foregoing type is disclosed in U.S. Pat. No. 3,969,778 with a mounting bracket, designed to be attached to a WC pan using the normal seat-attachment bolt holes in the pan, and side support legs which contact the floor alongside the WC pan. The legs are pivotally attached to the bracket some distance above the top surface plane of the WC pan and the arms are pivotally supported on the respective legs about upwardly inclined axes, so that they can be pivoted out of the way to allow side access to the toilet seat. With this prior construction a large portion of any vertical loading applied to the structure, for example by a heavy person leaning on one of the arms, is withstood by the WC pan. As a result of this, and also if offset or side loads are applied to the arms, damagingly high stresses can be applied to the WC pan and in extreme cases breakage of the latter can occur.

SUMMARY OF THE INVENTION

The object of the invention is to provide a construction of toilet aid with which the vertical loading and bending moments which have to be withstood by the WC pan are materially reduced, while retaining the advantages of fixing using the normal seat-attachment bolt holes.

According to the invention a toilet aid comprises a rear fixing bracket for mounting on a WC pan using the normal seat-attachment bolt holes of the latter, side support arms and support legs mounted on the bracket for separate pivotal movement about a common horizontal axis disposed adjacent the top surface of the pan in the region of said seat-attachment bolt holes, said support legs being adapted to contact the floor (when viewed from the side) more or less directly below the outer front end of the side support arms.

Preferably the bracket is of simple form comprising a length of flat metal strip with turned-up end lugs which receive pivot bolts on which the arms and legs are mounted. Each end pivot bolt may provide a common pivot for the support leg and the side arm at the corresponding side of the WC pan, and the mounting of the arm may be such that it engages the leg to limit pivotal arm movement at the operative side support position. The bracket may have a long central bolt-fixing slot, or two shorter slots, to provide a universal construction which accomodates the range of bolt-hole spacings of WC pans likely to be met in practice.

It will be appreciated that minimum weight loading of the WC pan is achieved if the support legs contact the floor directly below the handgrips, considering the installation as viewed from the side. To enable this desirable condition to be achieved with a range of WC pan heights, the legs may be of adjustable effective length. Such adjustment may be of a telescopic nature.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be made as desired by those skilled in the art without departing from the present invention and the purview of the appended claims.

DESCRIPTION OF THE PREFERRED EMBODIMENTS

Figure 1:
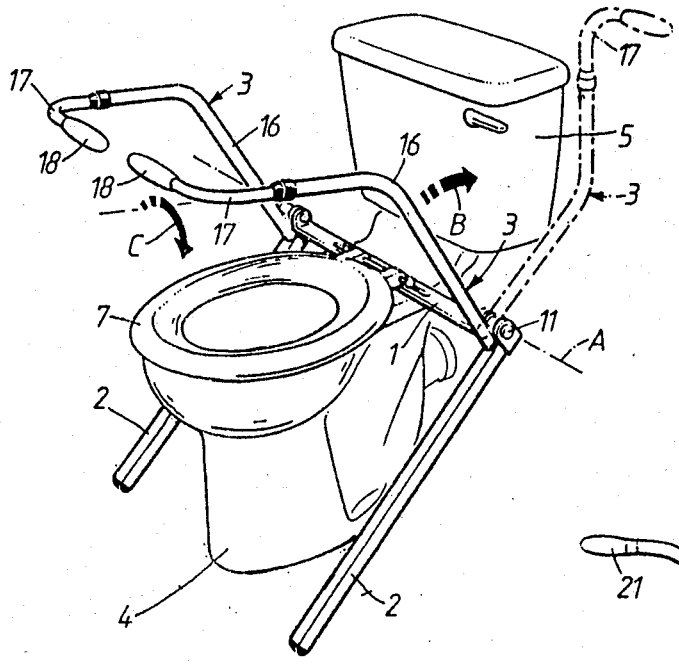
FIG. 1 is a perspective view showing a toilet aid in accordance with the invention, shown in the normal operative position.

The toilet aid illustrated comprises a mounting bracket 1, two identical side support legs 2, and two side arms 3 which are also identical apart from being "handed" as will be clear from the following description. The bracket 1 is of simple form, comprising a length of steel strip which extends laterally across the upper surface of the pan of a WC pedestal 4 which also supports the usual low-level flush box 5. The bracket 1 is secured to the pan 4 by the usual seat-attachment bolts 6 which attach a standard toilet seat 7 to the pan 4. To provide a universal fixing which accommodates the range of bolt spacings likely to be met in practice the bracket 1 has a long central bolt-fixing slot 8. At its ends the bracket 1 has upturned lugs 9 with holes 10 which receive pivot bolts 11, these being shouldered bolts secured by lock nuts 12 on the inner side of the lugs 9.

At its upper end each leg 2, which is of square-section tubular steel material, has a U-shaped attachment bracket 13 with aligned bores 14 through which the corresponding bolt 11 passes. Located within the bracket 13 is a tubular pivot boss 15 through which the bolt 11 also passes and which is welded to the corresponding tubular steel arm 3 at the rear end and on the upper side thereof. Thus the legs 2 and arms 3 are pivotally mounted about a common horizontal axis A located close to the pan in the region of the seat-attachment bolt holes.

Each arm 3 comprises a rear and main side portion 16, which extends upwardly and then generally horizontally but slightly upwardly inclined from the pivot axis A, and an end arm portion 17 which is bent round through a right angle. Each end portion 17 fits and turns within the front end of the corresponding main side portion 16. In the operative position illustrated the end portion 17 extend generally horizontally in front of, and thus provide front support for, a user seated on the toilet seat 7. In the inturned front support position illustrated there is a small gap of some 3 inches between the end arm portions 17 which, at their free ends, are fitted with moulded handgrips 18. Thus the user is effectively encircled and cannot fall off the toilet seat 7.

In FIG. 1 the left-hand arm is illustrated in a raised position, to which it can be moved about the pivot axis A in the direction of the arrow B past the flush box 5. In this raised position the corresponding side of the toilet seat 7 is unobstructed to allow side entry and exit of the user, from and to a wheelchair for example. The end portions 18 can be turned upwardly and outwardly, as shown by the arrow C, to a front entry position in which they project generally horizontally allowing free entry and exit at the front between the arms 3. In the out-turned positions of the arm portions 17, this position being illustrated in broken lines with the raised arm 3 of FIG. 1, the handgrips 18 provide considerable assistance for the user whilst manoeuvring on to and off the seat 7, from and back into a wheelchair and also when using the toilet in a standing position.

The length of the support legs 2 is such that they contact the floor slightly forwardly of the WC pan 4 and more or less directly below the handgrips 18, considering the installation in side view. This feature, plus the positioning of the horizontal arm/leg pivot axis A close to the top surface of the WC pan 4, ensures that the latter is relieved of most of the vertical loading and any twisting moments applied to the toilet aid in use. Thus the heaviest patient leaning on one of the side arms 3 cannot result in the application of damagingly high stresses to the WC pan 4. In a modification, as shown in phantom in FIG. 3 the legs 2 are of telescopically adjustable effective length so that they can be adjusted and locked in position, by any suitable means such as locking bolt 22, to achieve optimum floor contact positions with the full range of WC pan heights met with in practice.

Figure 3:
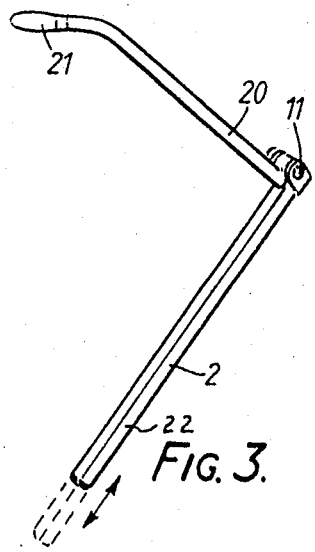
FIG. 3 illustrates a modified arm/leg arrangement.
Figure 2:
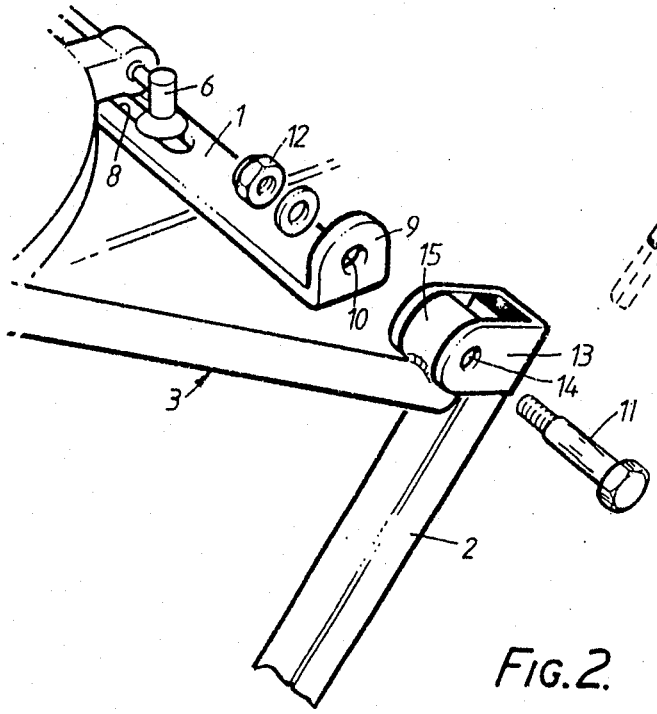
FIG. 2 is a detail and partly exploded view to a larger scale.

FIG. 3 also illustrates an alternative side arm/leg arrangement. The support leg 2 is identical but the side arm 20 is of simplified one-piece tubular construction with an outer generally horizontal end which is not inturned and which is provided with a moulded handgrip 21. This simplified arm arrangement is suited to less disabled users who, in particular, do not require when seated the front support provided by the inturned arm portions 17 of FIG. 1.

What is claimed is:

1. A toilet aid comprising a rear fixing bracket for mounting on a WC pan using the normal seat attachment bolt holes of the latter, two side support arms each terminating in an inturned outer end portion providing a handgrip for a user of the WC pan, and two side support legs, said arms and said legs being mounted on the bracket for separate pivotal movement about a common horizontal axis disposed adjacent the top surface of the WC pan in the region of said seat attachment bolt holes, said pivotal movement of said side support arms accommodating movement thereof between a lower operative position in which the arms are positioned to support the user of the WC pan and a raised inoperative position in which the arms do not obstruct normal use of the WC pan, and said support legs being adapted to contact the floor (when viewed from the side) forwardly of the base of the WC pan so that the legs support at least a major portion of any weight loading of the side support arms when the latter are operatively positioned.

2. A toilet aid comprising a rear fixing bracket for mounting on a WC pan using the normal seat attachment bolt holes of the latter, two side support arms and two side support legs, said arms and said legs being mounted on the bracket for separate pivotal movement about a common horizontal axis disposed adjacent the top surface of the WC pan in the region of said seat attachment bolt holes, said pivotal movement of said side support arms accommodating movement thereof between a lower operative position in which the arms are positioned to support a user of the WC pan and a raised inoperative position in which the arms do not obstruct normal use of the WC pan, stop means associated with each support arm for contacting the respective support leg when the support arm is in the lower operative position so as to support said support arm thereon and said support legs being adapted to contact the floor (when viewed from the side) substantially directly below the outer front end of the support arms so that the legs support at least a major portion of any weight loading of the side support arms when the latter are operatively positioned.

3. A toilet aid comprising a rear fixing bracket for mounting on a WC pan using the normal seat attachment bolt holes of the latter, two side support arms and two side support legs, said arms and said legs being mounted on the bracket for separate pivotal movement about a common horizontal axis disposed adjacent the top surface of the WC pan in the region of said seat attachment bolt holes, said pivotal movement of said side support arms accommodating movement thereof between a lower operative position in which the arms are positioned to support a user of the WC pan and a raised inoperative position in which the arms do not obstruct normal use of the WC pan, and said support legs being adapted to contact the floor (when viewed from the side) substantially directly below the outer front ends of the support arms so that the legs support at least a major portion of any weight loading of the side support arms when the latter are operatively positioned.

4. A toilet aid according to claim 3, wherein said bracket comprises a length of flat metal strip adapted to seat on the top surface of the WC pan and having turned-up end lugs, said lugs receiving aligned pivot bolts on which the arms and legs are mounted for said separate pivotal movement.

5. A toilet aid according to claim 3, wherein the side support arm and support leg, at each side of the toilet aid, are mounted on a corresponding pivot bolt which provides a common pivot for that support leg and side arm at the corresponding side of the WC pan.

6. A toilet aid according to claim 3, wherein the pivotal mounting of each of said side support arms is such that it engages the corresponding one of said side support legs to limit pivotal arm movement of the arm at said operative position thereof, so that the support arms respectively react against the support legs to support weight loading of the arms.

7. A toilet aid according to claim 3, wherein the side support legs are of adjustable effective length.

8. A toilet aid according to claim 7, wherein the side support legs are of telescopic construction for length adjustment.

* * * * *